US005348190A

United States Patent [19]

Mizzi et al.

[11] Patent Number: 5,348,190

[45] Date of Patent: Sep. 20, 1994

[54] INSERT MODULE AEROSOL CONTAINER

[75] Inventors: John V. Mizzi; Donald A. Merte, both of Poughkkeepsie, N.Y.

[73] Assignee: Omnific International Ltd., Poughkeepsie, N.Y.

[21] Appl. No.: 934,780

[22] Filed: Aug. 24, 1992

[51] Int. Cl.[5] ..... B05B 9/00

[52] U.S. Cl. ..... 222/82; 222/325; 222/401; 222/402.1; 239/309; 239/357; 239/360; 239/363

[58] Field of Search ..... 222/209, 325, 401, 402.1, 222/81, 82, 85; 239/337, 355, 357, 360, 363, 373, 309

[56] References Cited

U.S. PATENT DOCUMENTS 3,995,779 12/1976 Mizzi ..... 222/401
4,147,284 4/1979 Mizzi ..... 222/401
4,341,330 1/1982 Mascia et al. ..... 222/401

FOREIGN PATENT DOCUMENTS 3445101 1/1986 Fed. Rep. of Germany ..... 222/401
560349 4/1957 Italy ..... 239/363

*Primary Examiner*—Andres Kashnikow
*Assistant Examiner*—Anthoula Pomrening
*Attorney, Agent, or Firm*—Alfred M. Walker

[57] ABSTRACT

The present invention includes an improved apparatus for discharging liquids in a spray, including a separable housing, a recyclable liquid module containing liquid to be sprayed and a weight activated air compressor or pump which supplies compressed air to the liquid module upon agitation of the entire apparatus. The liquid module including the liquid within forms part of the driving weight utilized by the pump. The liquid module is inserted into the separable housing and can reciprocate within the housing; it is connected to the pump with a conduit and coupling for the transfer of compressed air to the liquid module. A second conduit conducts liquid to be sprayed from the liquid module to the outlet valve for discharge.

6 Claims, 5 Drawing Sheets

FIG. 3
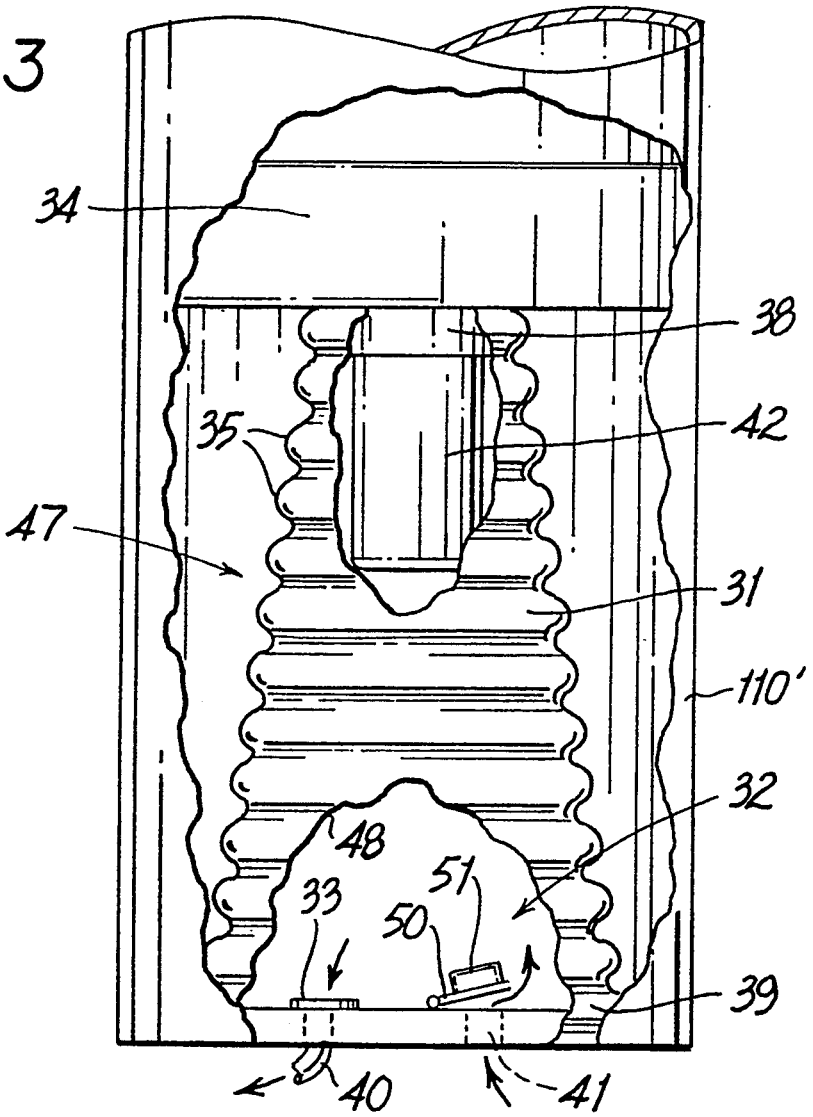
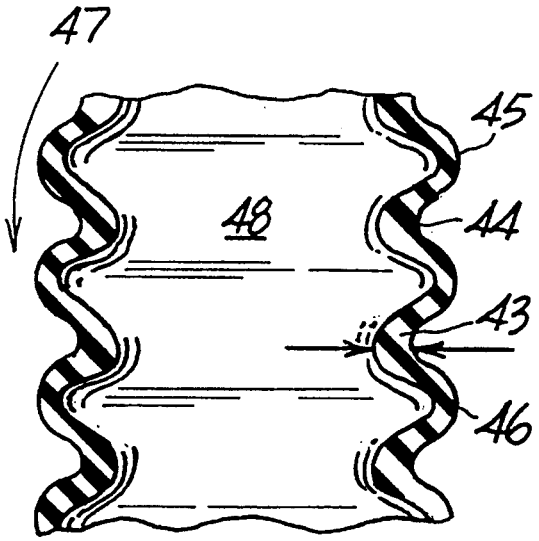
FIG. 3A
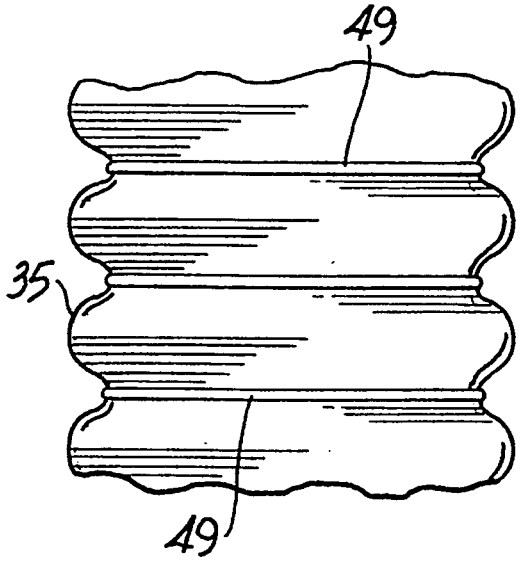
FIG. 3B

INSERT MODULE AEROSOL CONTAINER

BACKGROUND OF THE INVENTION

The present invention relates to an aerosol dispenser which uses compressed air as the propellant. The adoption of this dispenser as a substitute for ordinary household aerosols eliminates the use of chemical propellants such as chlorofluorocarbons or hydrocarbons and reduces solid waste. The nondisposable dispenser, with recycable insertable product modules, uses air as the propellant. This is generated by the natural act of shaking the dispenser a few times before using which compresses air via a small pump located inside the unit.

DESCRIPTION OF THE PRIOR ART

The prior art includes U.S. Pat. Nos. 3,995,779 and 4,147,284 of the Applicant. These patents pertain to the use of compressed air to urge a liquid spray from a dispenser, instead of conventionally using a chemical propellant, which may be harmful to the environment.

SUMMARY OF THE INVENTION

The present invention improves the prior art with the following novel features. For example, the outer housing splits apart to permit the insertion and removal of factory filled recyclable product containers.

A further improvement is provided in the use of tapered bellows as a pumping air compressor elements.

Generally, the present invention includes a liquid module containing a liquid to be sprayed, and a pump module with an air compressor pumping means, with the liquid spray flowing in response to urging by the compressed air.

The pumping means of the pumping module may use a piston and cylinder compressor wherein the cylinder is an integral part of the recyclable product container. A reusable weight disk attached to the discharge hose is clipped onto the product container with the same motion required to pierce the seal on the container top to attach the discharge hose coupling to the dip tube which is integral to the container. This adds inertia to the container, which is beneficial when the liquid content is at a low level and the weight contribution of the liquid is minimal, however in normal use it is seldom necessary to pump the dispenser by shaking at this point since an excess of compressed air propellant has usually accumulated in the product container by the time it is almost empty. The product container may be a standard type metal can, or a plastic container.

The pumping means of the pumping module may alternatively use a tapered bellows compressor. The tapered bellows version permits more standard can manufacture in that a cylinder and outlet check valve need not be part of the can bottom as in the piston and cylinder case. In the bellows version, the internal product container is guided by the sides of the housing in its pumping excursions. In either compressor version, the product container is removed or inserted in a manner very similar to replacing batteries in a flashlight.

Using a piston and cylinder type of compressor is a workable solution. However, sizing the stroke, bore and driving weight is a compromise which stacks a desire for quick pressure buildup of an unpressurized depleted container against a desire for high maximum pressure with a given weight and oscillatory frequency. A bellows would pose a similar compromise.

The piston and cylinder pumping module may be further modified with a telescoping piston and cylinder assembly. This particular assembly has three cylinders which nest into each other and a small piston. Appropriate seals must be fitted to each section and extension limits (strings) must be used to limit the excursion of each section during the fill stroke. This achieves some advantage in that with low back pressure, such as in a startup condition or in a depleted pressure situation in a product container, the entire array will be flattened to a significant height, thus compressing a large volume of air per stroke. As the back pressure quickly builds up, the down stroke force will no longer be adequate to compress the air in the largest cylinder. In effect, the large section decouples and stays dormant. The upper sections keep pumping until back pressure decouples the next section and so forth until finally, even the top solid piston "locks up" against back pressure.

The bellows analog to this approach, a tapered bellows, does not have these shortcomings. For the bellows, however, there are other design considerations which must be addressed. At high pressure, a bellows tends to billow out at the root radii instead of fold down. This tendency is more pronounced as the diameter increases. This is a problem associated with a tapered bellows, since the large convolutions are at peak pressure imposed by the smaller convolutions. One way to control this is by judicious attention to careful materials specification. This is an option strictly for injection molding. Another method is to fit external rings at the root of each of the larger convolutions. A preferred process is to take a completed bellows of any manufacture and to apply reinforcing fibers in the circumferential direction by first dipping the bellows in appropriate adhesive and then rolling on the fiber reinforcement. This thickening of selected portions of the bellows surface supplies just the right kind of anisotropic reinforcement, to resist radial expansion, while not adversely affecting the longitudinal suppleness of folding capability. In this manner, even inexpensive dip molded bellows of thin uniform cross section can be made usable for this application.

To preserve some volume per reduced stroke at the higher pressures, in a further embodiment, the narrow section of the bellows is extended a few convolutions. Unfortunately, this produces an instability in the geometry with a tendency for the bellows to bend instead of fold neatly upon compression. This problem is be solved in two complementary ways. First, the top section is made a bit wider than the design point would suggest, with shallower convolutions and a larger root diameter. This in itself reduces the tendency to bend, but it may not produce the desired high pressure. The latter capability can be restored, while at the same time insuring straight folding without bending, by fitting the top section of the tapered bellows with a short guide rod internally that takes up most of the root diameter of the extended section of small convolutions. The effective volume of this top section is reduced by the rod volume, thereby insuring high pressure results.

When either the telescoping cylinders or the tapered bellows is utilized as the pumping means, special attention is given to the design of the inlet check valve. In either a simple piston and cylinder or a straight bellows, the vacuum generated during extension is substantial and uniform during the entire intake stroke. Small resistance from the inlet check valve is easily overcome and the internal volume is quite well filled for the pressure stroke. In contrast in the variations discussed above, at higher pressures the internal volume is almost full of air at atmospheric pressures or above until the very last bit of the intake stroke. At this point a very small vacuum is formed by virtue of the slightly increased internal volume as can be predicted by gas laws. This small vacuum will not pull in more air through the normal spring loaded ball check or duckbill type valve. This makes the high pressure section of a tapered bellows ineffective, since the required small increase of air in the internal volume never enters during the "intake" stroke. A virtually zero resistance inlet check valve is required for this application. Flap valves can approach this capability but they tend to be leaky in very small sizes. The solution is a weight operated inlet check valve. The inlet stroke coincides with the container being pulled down relative to the compressor driving weight; this results in the bellows extending. Therefore the valve has a weight attached to it, such that it would open during the same motion of the bellows extending. If the opening itself is sufficiently large as to be minimally restrictive, this would result in the capability of even a slight vacuum pulling in more air. Additionally, the weight that opened the valve on the downstroke helps to seal the valve on the upstroke compression stroke. Many design configurations exist for this type of valve. They include ball type valves with ball attached weights, weighted flapper valves and any type of weighted moving seal valve.

OBJECTS OF THE INVENTION

It is an object of the invention to improve over air propellant aerosol dispensers.

It is a further object to provide an air propellant continuous spray dispenser which maximizes pressure even when the liquid content is low.

It is a further object to provide a bellows pump means wherein the root radii efficiently fold without billowing out.

It is a further object to provide an air propellant continuous spray dispenser with a low resistance inlet check valve.

The novel features which are considered characteristic for the invention are set forth in particular in the appended Claims. The invention, itself, however, both as to its construction and its method of operation, together with additional objects and advantages thereof, will best be understood from the following description of its specific embodiments, when read in connection with the accompanying drawings.

DESCRIPTION OF THE DRAWINGS

FIGS. 3, 3A, 3B, 3C, 3D, 3E, 3F and 3G show details of a second alternate tapered bellows portion of the pumping module of the invention.

DETAILED DESCRIPTION OF THE PREFERRED EMBODIMENTS

Figure 1:
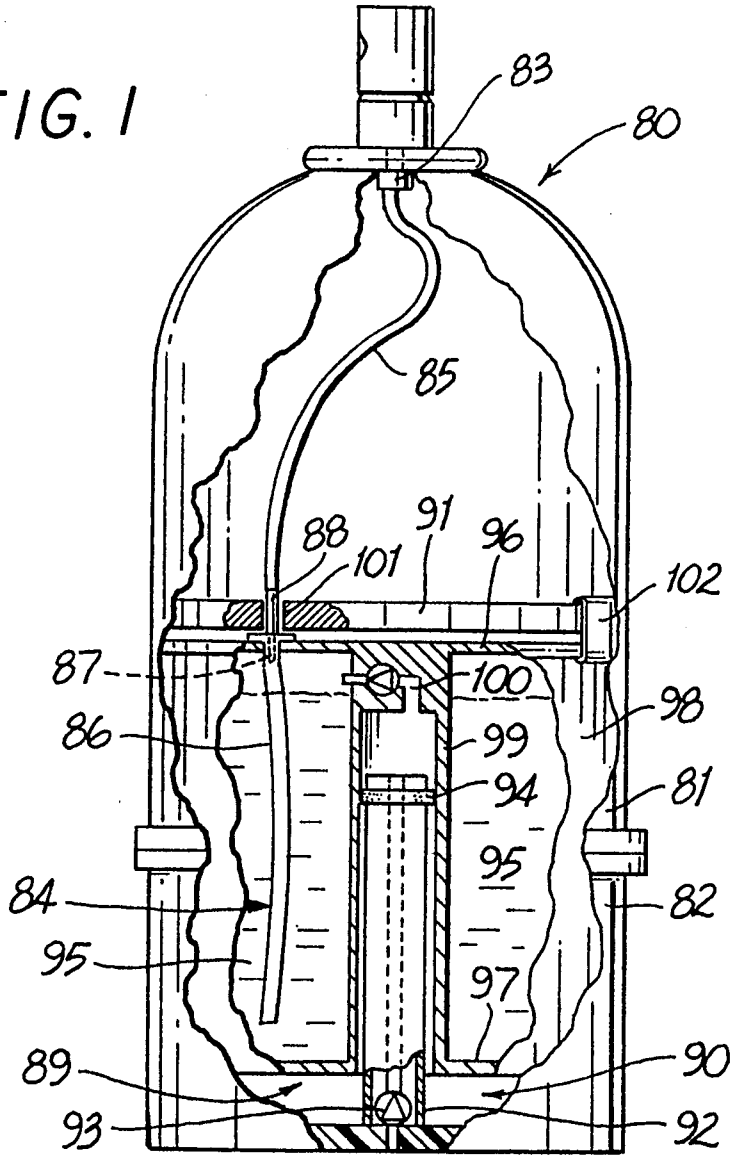
FIG. 1 is a side elevational view of one embodiment of the invention with a removable, insertable liquid container, showing a piston and cylinder pumping module.

As shown in FIG. 1, there is provided a configuration for an air propellant continuous spray dispenser for discharging liquids in a spray, including a separable exterior 80 housing, with an upper part 81 and a lower part 82, the upper and lower parts 81, 82 being conveniently attachable and separable.

The upper part 81 further has a discharge valve 83 and conduit 84 for conveying liquid to be sprayed to the discharge valve, the conduit having an upper end 85 and a lower end 86, the upper end 85 being connected to the discharge valve 83; a piercing connector 87, including a pointed tubular member 88 for mechanical piercing, the piercing connector 87 being attached to the lower end 86 of the conduit 84. A removable and replaceable liquid module 89 is disposed within both the upper 81 and lower 82 exterior housing parts, the liquid module 89 being reciprocally and slidably movable within the exterior housing 80 when the upper and lower exterior housing parts 81, 82 are conveniently attached. The reciprocal slidable motion of the liquid module 89 further provides an inertial impulse for compressing air in response to agitation of the exterior housing 80. The pump module 90 has a weight 91 moving reciprocally in register with the slidable reciprocal motion of the liquid module 89.

As shown in FIG. 1, the pump module 90 may contain a piston 92 and cylinder 99 arrangement, the piston 92 being capable of compression strokes, wherein the sequential inertial impulses provided by the weight 91 drive the piston 92 in its compression strokes.

The piston 92 is attached to and disposed within the lower part 82 of the exterior housing 80, the piston 92 having an inlet check valve 93 and a piston seal 94.

The removable and replaceable liquid module 89 is further provided with an interior liquid basin 95 containing the liquid to be sprayed, with a first 96 end and a second end 97 and at least one wall 98 therebetween.

The second end 97 further has an axial bore 99 therein, the axial bore 99 being disposed parallel to the at least one wall 98. The axial bore 99 further includes a cylinder mateable with and in slidable relation to the piston 92, the piston 92 providing directional guidance to the liquid module 89. The axial bore 99 further is sealed from communication with the interior liquid basin 95, except that the axial bore 99 is provided with a check valve 100 to permit air compressed by the piston 92 to exit the axial bore 99 and sealably enter the interior liquid basin 95.

The removable and replaceable liquid module 89 is further provided with a conduit 84 disposed within the interior liquid basin 95, the conduit 84 extending into and conducting the liquid to be sprayed toward the first end 96 of the liquid module 89.

The conduit 84 is attached to the first end 96 of the liquid module 89 in positional register with the piercing connector 87 disposed within the upper part 81 of the exterior housing 80, to permit the piercing connector 87 to pierce the liquid module 89 so that the liquid module conduit accommodates the piercing connector 87. This connection forms a complete pathway for the liquid to be sprayed, starting with the interior liquid basin 95 of the liquid module 89 and ending with the discharge valve 83 disposed in the upper part 81 of the exterior housing 80.

The piercing connector 87 is sealably inserted into the liquid module interior basin conduit 86 of conduit 84. The piercing connector 87 is further provided with a weight 91, the weight 91 having a bore 101 therethrough, and the piercing connector 87 being inserted into and traversing the bore 101.

The weight 91 is provided with a clip means 102, the clip means 102 providing for the weight 91 to be removably attached to the liquid module 89, the weight 91 moving slidably and in registry with the liquid module 89 for providing inertial force for compressing air.

Figure 2:
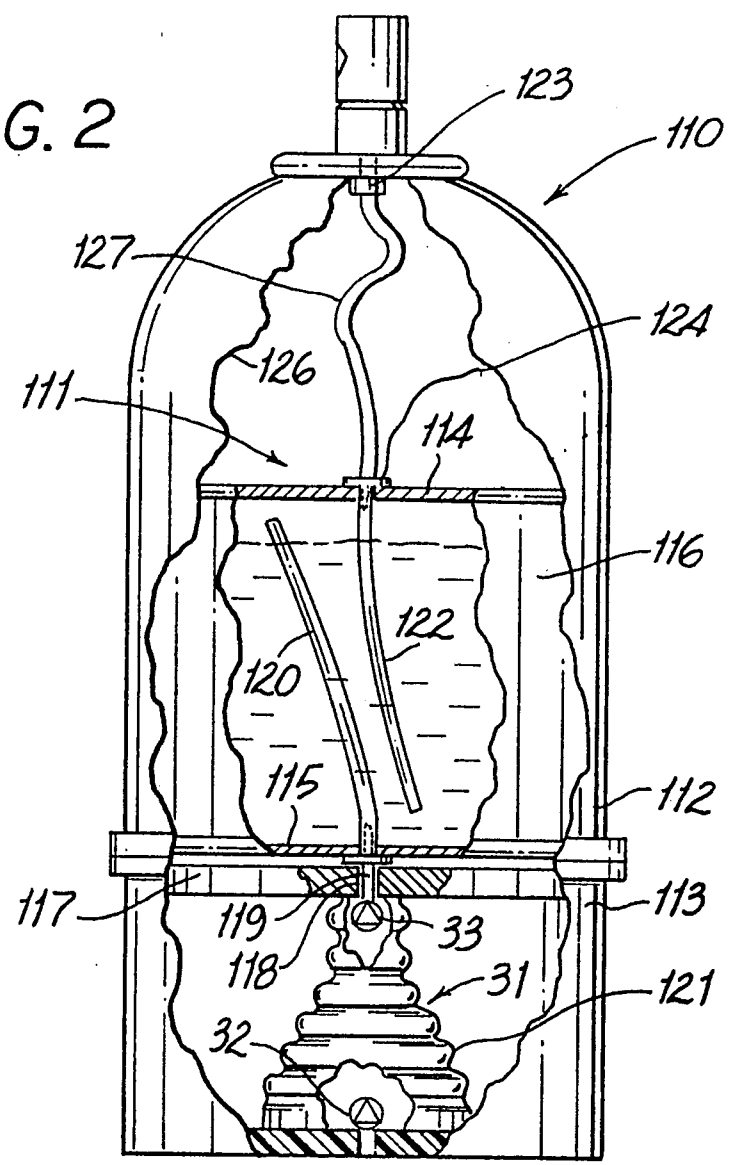
FIG. 2 is a side elevational view of the invention as shown in FIG. 1, wherein the pumping module includes a first tapered bellows air compressor.

As shown in FIG. 2, there is shown a first alternate dispenser 110 having an insert module 111 within external housing 112.

As shown in FIG. 3, a second alternate dispenser 110' contains a weight activated tapered bellows pumping means 31, and two check valves 32, 33 for preventing backflow of compressed air, the tapered bellows 31 being capable of compression strokes, wherein the sequential inertial impulses provided by the weight 34 drive the tapered bellows 31 in its compression strokes.

The tapered bellows 31 includes a plurality of contiguous adjacent folded surfaces 35, each contiguous adjacent folded surface 35 being pliably capable of extensive and compressive motion relative to adjacent folded surfaces 35.

The plurality of contiguous adjacent folded surfaces 35 form a pliable sealed air container 31 having an interior 48, an exterior 47, a first end 38 and a second end 39, wherein one folded surface 35 comprises the first end 38 and one folded surface 35 comprises the second end 39 of the tapered bellows 31, the tapered bellows 31 further having an exit 40 of compressed air and an inlet 41 for ambient air to be compressed, and an axial guidance pin 42 for aligning the folding of tapered bellows surfaces 35 during compression.

Figure 3C:
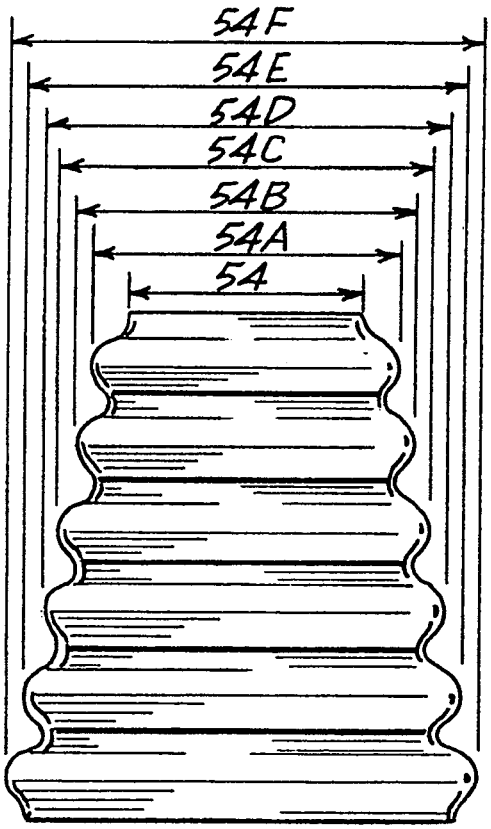
Figure 3D:
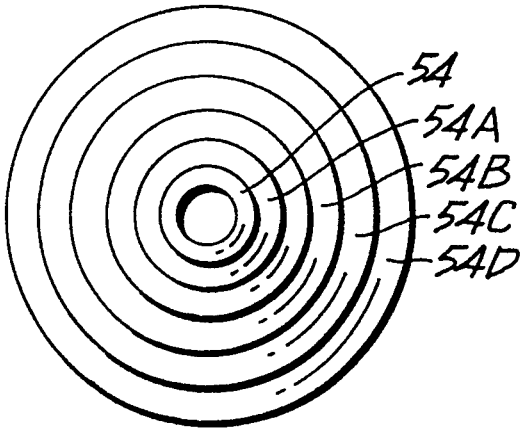
Figure 3F:
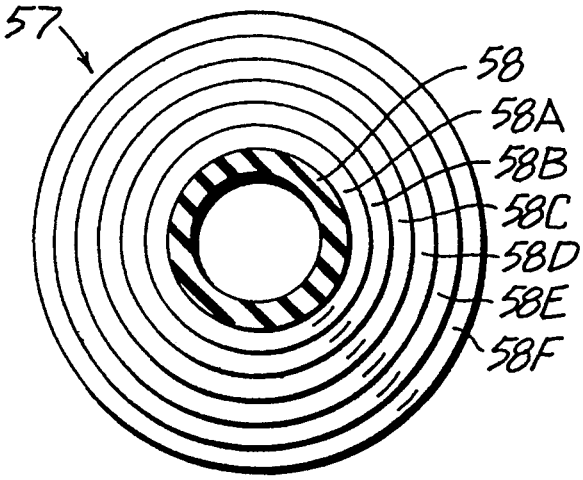

As shown in FIG. 3A, the tapered bellows contiguous adjacent folded surfaces 35 have a thickness 43, a central portion 44 and edges 45, 46, each tapered bellows contiguous folded surface 35 being joined with adjacent folded surfaces 35 at the edges 45, 46.

The tapered bellows contiguous adjacent folded surfaces 35 have an exterior 47 and an interior 48, the thickness 43 being disposed therebetween, the exterior 47 of the surfaces 35 comprising the exterior of the sealed air container 31 and the interior of the surfaces 35 comprising the interior of the sealed air container 31.

As shown in FIG. 3B, the tapered bellows 31 contiguous adjacent folded exterior surfaces 35 may be with reinforcing fibers 49, the reinforcing fibers 49 being circumferentially and adhereingly wrapped about and attached to the exterior surfaces 35, the reinforcing fibers 49 for providing dimensional and directional guidance to the tapered bellows 31 during compression.

The second alternate dispenser 110' has an inlet check valve 32, and an outlet check valve 33, the inlet check valve having an open position, a closed position, a flap 50 capable of moving between the open and the closed position, and a weight 51 disposed upon the flap 50 for holding the flap 50 in the closed position, the weight 51 and flap 50 being movable from the closed to the open position in response to mechanical agitation of the second alternate dispenser 110', and from the open to the closed position in response to gravity and the mechanical agitation of the second alternate dispenser 110'.

Figure 3E:
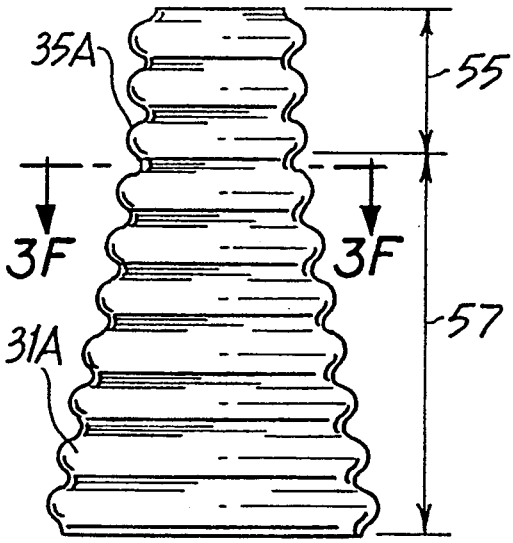
Figure 3G:
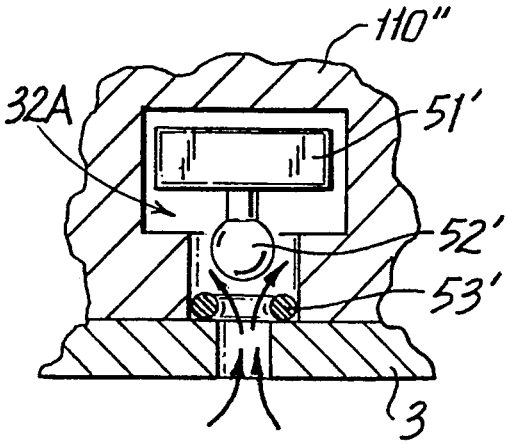
Figure 4:
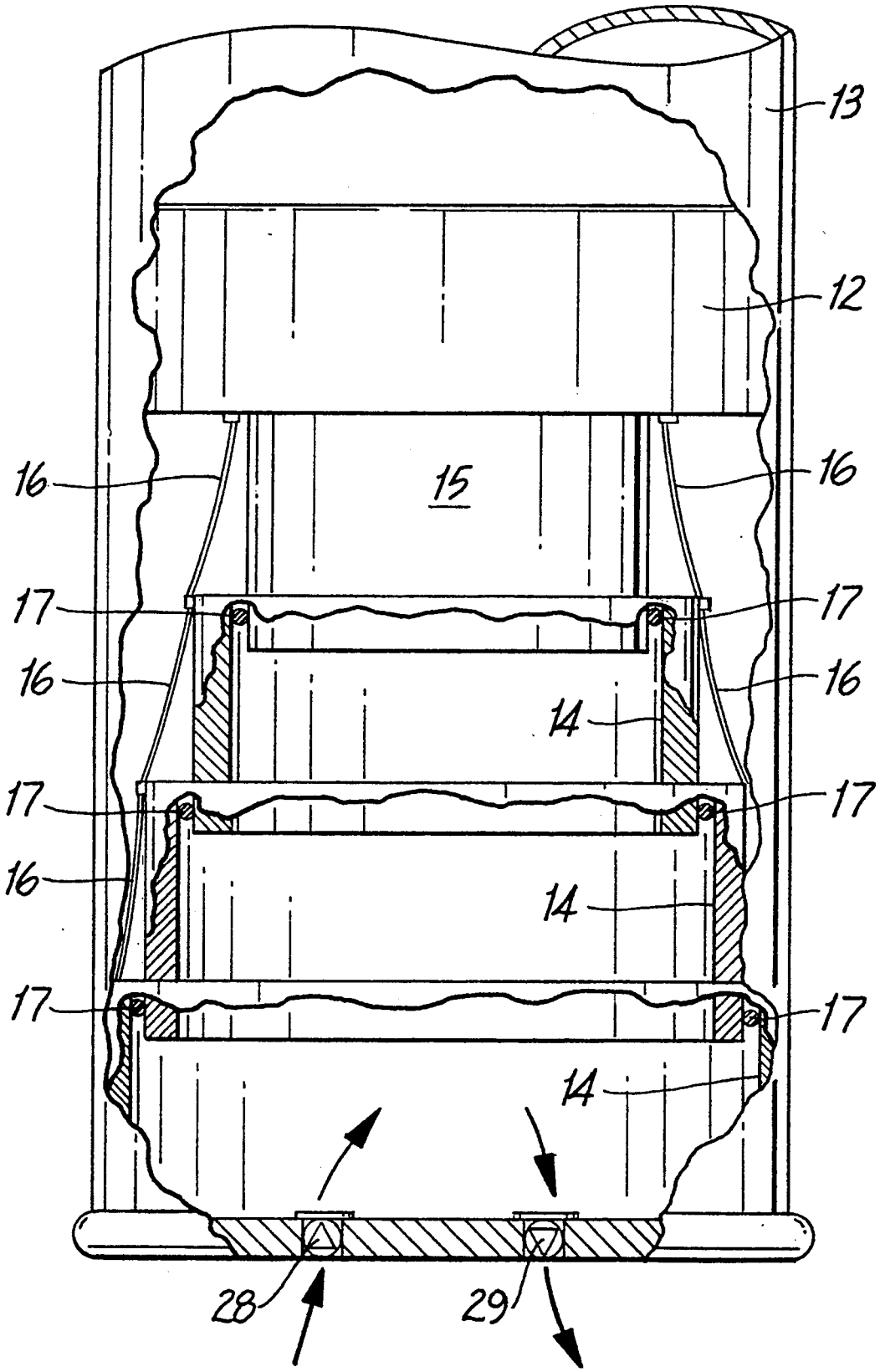
FIG. 4 is a side elevational view of a telescoping piston and cylinder portion of the pumping module of the invention.

Alternatively, as shown in FIG. 3G, a third alternate dispenser 110' may have an alternate inlet check valve 32A, the inlet check valve 32A having an open position, a closed position, a weight 51', and a ball 52' and O-ring 53' sealing means capable of moving between the open and the closed position.

The weight 51' for holding the O-ring 53' sealing means is in the closed position, and the weight 51' and O-ring 53' sealing means are movable from the closed to the open position in response to mechanical agitation of the third alternate dispenser 110'' and movable from the open to the closed position in response to gravity and the mechanical agitation of the pump module.

Figure 5:
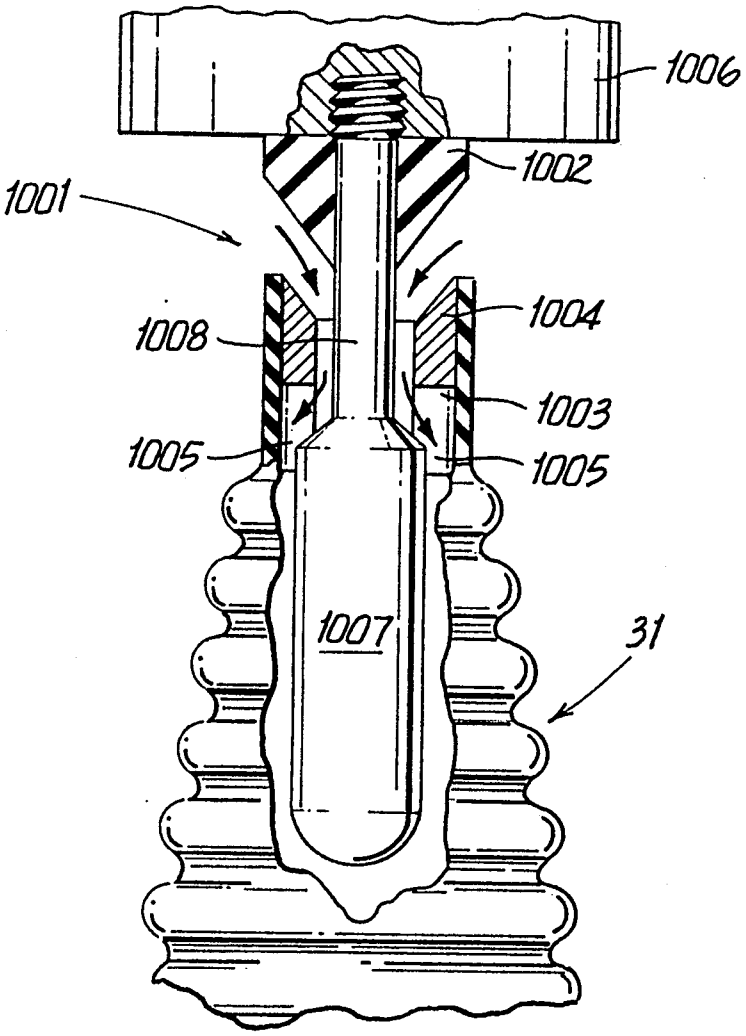
FIG. 5 is a side elevational view of a preferred embodiment for an inlet check valve for a tapered bellows embodiment of the pumping module of the invention.

Alternatively, as shown in FIG. 5, the tapered bellows pump may have a weight-operated bellows inlet check valve 1001, including a driving weight 1006, a relatively narrow, elongated connecting shaft 1008, and a guidance pin 1007, the connecting shaft 1008 being disposed between and connecting driving weight 1006 and guidance pin 1007 such that driving weight 1006, connecting shaft 1008 and a guidance pin 1007 constitute an integral compression unit capable of vertical sealing and unsealing motion, with the driving weight 1006 being disposed in a top position, the connecting shaft 1008 being disposed in a medial position, and the guidance pin 1007 being disposed in a bottom position within and relative to the integral compression unit.

The pump means further has a soft seal 1002, preferably rubber, mounted upon connecting shaft 1008 by means of a vertical bore through soft rubber seal 1002. The vertical bore sealably accepts insertion of the connecting shaft 1008 therethrough. The soft rubber seal is in an unmovable relationship to connecting shaft 1008. The pump means also has a hollow cylindrical bellows mounting collar 1003, the mounting collar 1003 further having a top and a bottom, the top further including a beveled valve seat 1004 and the bottom having beveled notches 1005, such that the soft rubber seal 1002 is inertially urged into sealable contact with beveled valve seat 1004 by driving weight 1006 during the bellows compression stroke.

The vertical sealing motion of the integral compression unit provides the compression stroke, the vertical sealing motion of the compression unit being relative to mounting collar 1003, the vertical unsealing motion of the compression unit including upward motion of the compression unit relative to mounting collar 1003.

The weight operated bellows inlet check valve permits ambient air to enter the bellows in response to the unsealing motion of the compression unit and the weight operated bellows compresses air within the bellows in response to the sealing motion of the compression unit.

The plurality of contiguous adjacent folded surfaces 35 may include alternatively a tapered continuum of dimensional variation, wherein each such folded surface 35 has a cross sectional area 54, the folded surface 35 comprising the first end 38 having the smallest cross sectional area 54 and each successive folded surface 35A therefrom having progressively larger cross sectional areas 54A, 54B, 54C, 54D, etc.

As shown in FIG. 3E, the tapered bellows contiguous adjacent folded surfaces 35 include a section 55 which is dimensionally uniform and a section 57 which is dimensionally tapered, wherein the section 55 which is dimensionally uniform and the section 57 which is dimensionally tapered comprise a single sealed tapered bellows air container 31A.

The section 55 which is dimensionally uniform has a uniform cross sectional area 58 smaller than the smallest cross sectional area 58A of the dimensionally tapered section 57.

The dimensionally tapered section 57 varies uniformly from a smallest cross sectional area 58 to a largest cross sectional area 58F.

The dimensionally tapered section 57 is contiguous with the dimensionally uniform section 55 such that the dimensionally tapered section 57 is smoothly joined to the dimensionally uniform section 55, with the smallest cross sectional area 58A of the dimensionally tapered section being disposed nearest to the dimensionally uniform section 55.

As further shown in FIG. 2, the first alternative dispenser 110 has a removable and replaceable liquid module 111 slidably and reciprocally movable within the attached upper and lower exterior housing parts 112 and 113. The interior surface 126 of exterior housing device 110 guides the slidable motion of the liquid module 111. The liquid module 111 has a first end 114, a second end 115, at least one wall 116, and a weight 117 detachably secured to the second end 115 of the liquid module 111, the weight 117 having a bore 118 therethrough.

A first tubular piercing connector 119 is inserted into and transversing the bore 118, the piercing connector 119 for piercing the second end 115 of the liquid module 111.

A first conduit 120 is disposed within the liquid module 111 for conducting compressed air from a pump module 121 to the interior of the liquid module 111; the first conduit 120 being attached to the second end 115 of the liquid module 111 in positional register with the piercing connector 119.

A second conduit 122 is disposed within the liquid module, the second conduit 122 being attached to the first end 114 of the liquid module 111 for conducting the liquid to be sprayed from the liquid module 111 to a second tubular piercing connector 124 the second tubular piercing connector 124 for sealably piercing the liquid module 111 in positional register on the second conduit 122, Third conduit 127 connects the second tubular piercing connector 124 with the discharge valve 123 disposed in the upper part 112 of the exterior housing of device 110 thereby completing a pathway for the liquid to be sprayed starting with the liquid module 111, proceeding to the second conduit 122, the second piercing connector 124, the third conduit 127 and finally the discharge valve 123.

The foregoing description is directed towards the construction shown in the specifications and drawings herein, but basic modifications may be made, without departing from the spirit and scope of the appended Claims.

I claim:

1. An improved apparatus for discharging liquids in a spray, wherein the improvement comprises:

a. a separable exterior housing, comprising an upper part and a lower part, the upper and lower parts, being attachable and separable;

b. the upper part further comprising a discharge valve and conduit for conveying liquid to be sprayed to the discharge valve, the conduit having an upper end and a lower end, the upper end being connected to the discharge valve;

c. a piercing connector, comprising a pointed tubular member for mechanical piercing, the piercing connector being attached to the lower end of the conduit;

d. a removable and replaceable liquid module disposed within both the upper and lower exterior housing parts, the liquid module being reciprocally and slidably movable within the exterior housing when the upper and lower exterior housing parts are attached, the reciprocal slidable motion of the liquid module further providing an inertial impulse for compressing air in response to agitation of the exterior housing; and e. a pump module having a weight moving reciprocally in register with the slidable reciprocal motion of the liquid module.

2. The apparatus as in claim 1, wherein said pump module comprises and contains a piston-and-cylinder arrangement, the piston and cylinder arrangement being capable of compression strokes, wherein the sequential inertial impulses provided by said weight drives said cylinder of said piston and cylinder arrangement in its compression strokes within a guide means.

3. The apparatus as in claim 2, said piston and cylinder arrangement being attached to and disposed within said lower part of said exterior housing, said piston and cylinder arrangement having an inlet check valve and a piston seal; and a. said removable and replaceable liquid module being further provided with an interior liquid basin containing the liquid to be sprayed, with a first end and a second end and at least one wall therebetween;

b. said second end further having an axial bore therein, said axial bore being disposed parallel to said at least one wall;

c. said axial bore further comprising said cylinder mateable with and in slidable relation to said piston, said piston providing directional guidance to said liquid module;

d. said axial bore further being sealed from communication with said interior liquid basin, except that said axial bore is provided with a check valve to permit air compressed by said piston to exit said axial bore and sealably enter said interior liquid basin.

4. The apparatus as in claim 3, wherein said removable and replaceable liquid module is further provided with a conduit disposed within said interior liquid basin, said liquid module conduit extending into said liquid module and conducting the liquid to be sprayed toward said first end of said liquid module; and a. said liquid module conduit being attached to said first end of said liquid module in positional register with said piercing connector disposed within said upper part of said exterior housing, to permit said piercing connector to pierce said liquid module so that said liquid module conduit accommodates said piercing connector, thereby forming a complete pathway for the liquid to be sprayed, starting with said interior liquid basin of said liquid module and ending with said discharge valve disposed in said upper part of said exterior housing; and further, b. said piercing connector being sealably inserted into said liquid module interior basin conduit and further;

c. said piercing connector further being provided with said weight, said weight having a bore therethrough, and said piercing connector being inserted into and traversing said bore; and further, d. said weight being provided with a clip means, said clip means providing for said weight to be removably attached to said liquid module, said weight moving slidably and in registry with said liquid module for providing inertial force for compressing air.

5. The apparatus as in claim 1, wherein said pump module comprises and contains tapered bellows pumping means activated by said weight and an inlet check valve and an outlet check valve for preventing backflow of compressed air, said tapered bellows being capable of compression strokes, wherein the sequential inertial impulses provided by said weight drive said tapered bellows in its compression strokes.

6. The apparatus of claim 5 wherein said tapered bellows pumping means comprises a plurality of contiguous adjacent folded surfaces, each contiguous adjacent folded surface being pliably capable of extensive and compressive motion relative to adjacent folded surfaces.

* * * * *